United States Patent [19]

Mercer et al.

[11] 3,933,357

[45] Jan. 20, 1976

[54] SPINNER ASSEMBLY FOR BOARD GAME

[75] Inventors: Donald W. Mercer; Edward C. Horey, Jr., both of Pittsburgh, Pa.

[73] Assignee: Donbee Corporation, Pittsburgh, Pa.

[22] Filed: Apr. 15, 1974

[21] Appl. No.: 461,039

Related U.S. Application Data

[62] Division of Ser. No. 267,399, June 29, 1972, Pat. No. 3,853,322.

[52] U.S. Cl. ..... 273/141 R

[51] Int. Cl.[2] ..... A63F 5/04

[58] Field of Search ..... 273/141 R, 141 A, 134 E, 273/134 ES, 134 AD, 142 H, 142 HA, 161, 93 R; 35/39; 116/120, 131; 235/83, 116, 122

[56] References Cited

UNITED STATES PATENTS

| | | | |
|---|---|---|---|
| 651,811 | 6/1900 | Sexton | 273/134 E |
| 979,392 | 12/1910 | Munro | 273/134 ES |
| 1,167,407 | 1/1916 | Johnson | 273/141 R |
| 1,316,048 | 9/1919 | Le Massena | 273/134 ES |
| 3,545,758 | 12/1970 | Payne, Jr. | 273/141 R X |

FOREIGN PATENTS OR APPLICATIONS

| | | | |
|---|---|---|---|
| 958,975 | 5/1964 | United Kingdom | 273/141 R |

*Primary Examiner*—Anton O. Oechsle
*Assistant Examiner*—Arnold W. Kramer
*Attorney, Agent, or Firm*—Arnold B. Silverman, Esq.

[57] ABSTRACT

A board game simulating an athletic contest utilizes a plurality of spinner cards to provide the players with options. The spinner cards carry indicia associating them with positions on the game board corresponding to positions of the contestants on the playing field. A spinner assembly having a spinner disc, a spinner shaft and a pivotally mounted pointer arm is adapted for demountable securement to a number of spinner cards.

7 Claims, 3 Drawing Figures

SPINNER ASSEMBLY FOR BOARD GAME

This is a division of application Ser. No. 267,399, filed June 29, 1972, now U.S. Pat. No. 3,853,322.

This invention relates to a board game which simulates an athletic contest. It is more particularly concerned with such a board game including novel spinner means for determining by chance the outcome of plays available to the players of the game.

Board games simulating athletic contests are well-known. These usually employ a board representing the playing field of the contest and markers of some sort which are placed on the board to simulate the position of contestants on the playing field. These games are played by two people. Hereinafter, the term "player" signifies one or the other of the people who are playing the board game while the term "contestant" signifies one of the contestants in the athletic contest simulated by the game.

In one class of board games, the outcome depends ultimately on chance, which is invoked by rolling dice, spinning a spinner device, or by other means. The spinner device is essentially a pointer arm freely rotatable about a pivot in the center of a card containing a circular scale, the circumference of which is marked off into divisions representing various outcomes of the play. The player spins the spinner to determine his success or failure. My invention is concerned with board games of this class.

It is an object of my invention to provide a board game having a plurality of spinner means corresponding to options available to the players, which spinner means are associated with positions occupied by the contestants on the playing field by indicia on the board and on the spinner means. It is another object to provide a board game as above-described in which the spinner means may represent more than one option. It is another object to provide improved spinner means for board games. Other objects of my invention will appear in the course of the description thereof which follows.

An embodiment of my invention presently preferred by me is a board game simulating tennis, which will be described and illustrated hereinafter. It will be understood however, that my invention is not limited to tennis, but is adapted to other athletic contests as well.

My preferred embodiment is illustrated in the attached figures to which reference is now made.

Figure 1:
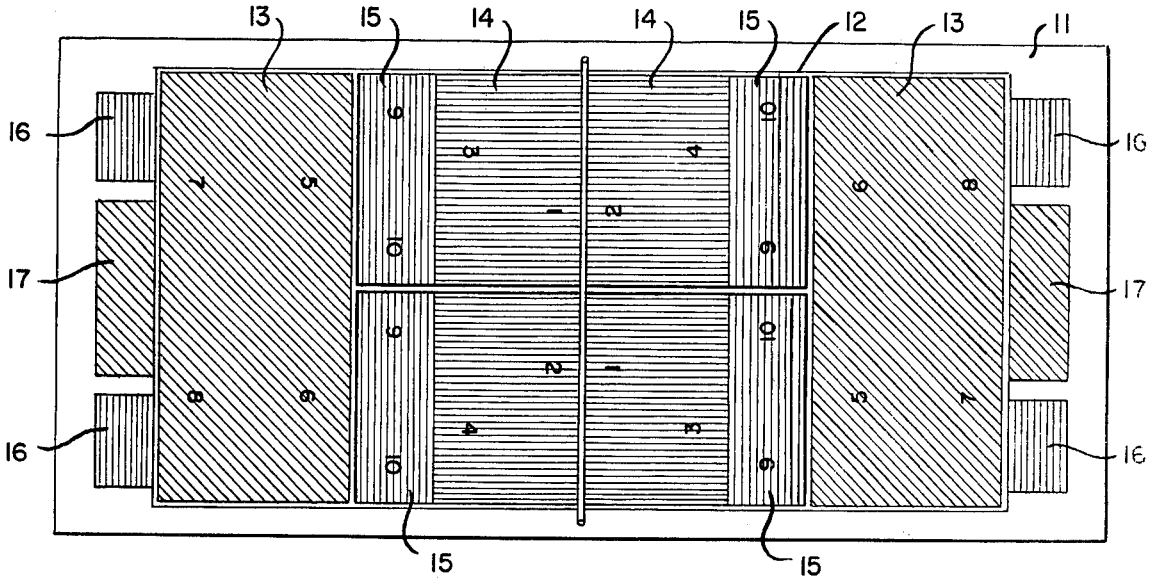
FIG. 1 is a plan of my game board.

My game board 11 carries the representation of a regulation singles tennis court 12, slightly modified as will appear. FIG. 1 is shaded for color. The two backcourt areas 13—13 are the same color, green. The two short forecourt areas 14—14 are the same color, blue. A deep portion 15 of each forecourt adjoining backcourt area 13 is colored red. The two service or serve return positions 16—16 behind each back line are colored the same color, red. The two backcourt positions 17 behind the back line are colored green. The numerals 1 through 10 which appear on board 11 in the places shown on each side of the court 12 are indicia affixed to the game board 11, and are not reference characters.

The game includes a marker for each contestant which is placed on game board 11 in the appropriate location as well as a marker for the ball, which may likewise be placed on the game board. These are not illustrated and require no further description because they are not part of my invention.

My game offers each player options at every stage thereof. Each option requires a different spinner device to determine its success or failure. It is a feature of my invention that the plurality of different spinner cards is comprehended by a detachable spinner mechanism described hereinafter which is used with any desired spinner card. The options and the spinner cards therefore are associated with the positions of the contestants on the tennis court. For example, the contest begins with one contestant serving from a service position 16 to the other contestant in the diagonally opposite court. In the simpler form of my game the server has the option of two serves, denominated the power serve and the spin serve, respectively. Each of these has its own spinner card. The spinner is spun by the player having the serve and it indicates if the ball is returnable, and if so, whether it must be returned from area 9 or 10 as marked by the numerical indicia on the board 11. My fully elaborated game also gives the server the option of trying to gain the net, which requires two more spinner cards, one for each type of service. The receiver has a total of eight options, depending on the server's choice of option, corresponding to different strategies in returning the serve. These require eight spinner cards. Furthermore, the outcome of each option is different for backhand or for forehand returns, which returns are predetermined by the portion of the court from which the serve must be returned, that is to say either area 9 or 10 on the appropriate side of the board.

If the serve is returned in play, the server then has a number of options open to him depending on whether the return is short or long, on his forehand or backhand, whether he has elected to go to the net or stay in the backcourt, and so on. In fact, the tennis game which I have devised to provide each player with most of the options available to a contestant on the court requires fifty-six spinner cards, nearly all of which have double scales as will be described. Without some quick and convenient way of associating or keying the appropriate spinner card with the positions of the contestants on the court, the effort required of the players would be greater than the game would support.

I have devised an effective means for associating the appropriate spinner cards with the positions of the contestants on the court employing corresponding indicia on the board and on the spinner cards. I utilize indicia of two types — color and numerals. Both of these appear on the board 11 illustrated in FIG. 1 which I have described. The spinner cards, to be described, are likewise identified by color and by numerals which associate the cards with the positions of the contestants on the court.

Figure 2:
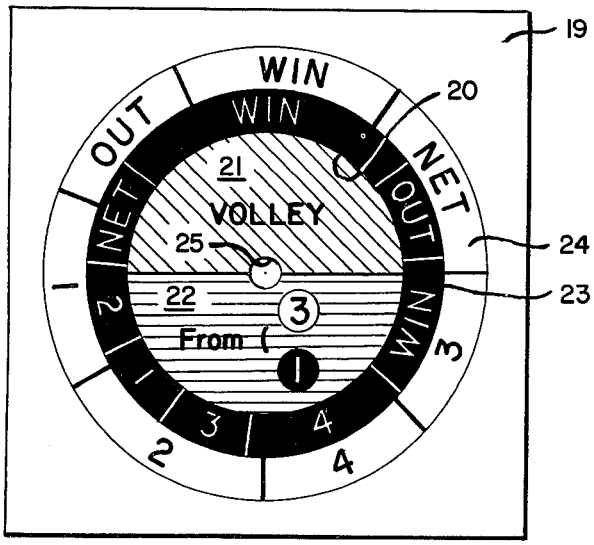
FIG. 2 is a plan of a spinner card.

A typical spinner card is illustrated in FIG. 2. This card 19 is provided with a central circular area 20 divided by a diameter into semi-circles 21 and 22. It is also provided with an inner circular scale 23 surrounding circular area 20 and an outer circular scale 24 surrounding inner scale 23. The card 19 is formed with a circular hole 25 concentric with circle 20 and circular scales 23 and 24 for the spinner mechanism of FIG. 3 to be described. Scales 23 and 24 are marked off in divisions indicating the outcome of the stroke which card 19 represents. Semi-circle 21 is colored the same color as the zone of the court occupied by the opposing contestant and semi-circle 22 is colored the same color as the zone occupied by the player having the ball in his court. In FIG. 2, semi-circle 21 is lined for green, indicating that the opposing contestant is in the backcourt 13, and semi-circle 22 is lined for blue indicating that the ball to be returned is in the short forecourt zone 14. Semi-circle 22 also is marked with two numerals, 1 and 3. These numerals are not reference characters but indicia applied to the spinner card 19 like the numerals which are applied to board 11 of FIG. 1. The numeral 1, which is applied as a white numeral on a black background, indicates that inner scale 23 must be used, which is likewise colored black with white numerals and legends. Numeral 3, which is applied as a black numeral on a white background, indicates that outer scale 24 must be used, which is likewise colored white with black numerals and legends. These numerals 1 and 3 on semi-circle 22 correspond to numerals 1 and 3 in blue court zone 14 of FIG. 1 and represent the position of the ball in the blue zone and accordingly the position in that zone occupied by the player who must return the ball. The position, of course, has resulted from the outcome of the preceding return of the opposing player, not here described, but determined by a spin of another spinner device with its own card.

The scales 23 and 24 of FIG. 2 indicate, by the legend "out", that the ball was outside the court, by the legend "net", that it went into the net, by the legend "win", that it was not returnable, or by one of the numerals that it fell within the opponent's court in the area corresponding to the numeral indicated. The scales comparable to scales 23 and 24 on the other spinner cards are generally similar.

Figure 3:
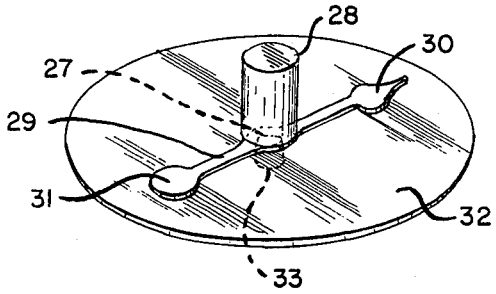
FIG. 3 is a perspective of my spinner device.

My spinner device is illustrated in FIG. 3. A shaft 27 is provided on one end with a finger grip portion 28 of somewhat greater diameter. Pivoted for free movement about shaft 27 adjacent finger grip 28 is a pointer arm 29 which has a pointer indicator 30 on one end. The other end of arm 29 terminates in a counter balance 31. Arm 29 is pivoted at a point intermediate indicator 30 and counter balance 31. A disk 32 of transparent material, preferably plastic, is fixed to shaft 27 so that pointer arm 29 is pivoted between disk 32 and finger grip 28. The radial extent of disk 32 is at least as great as the greatest radial extent of the pointer arm 29. The end 33 of shaft 27 projects through disk 32 a distance sufficient to permit it to be inserted into hole 25 of spinner card 19 previously described. My spinner device is thus adapted for use with any one of a plurality of spinner cards which has a center hole 25 of the size adapted to receive end 33 of spinner shaft 27. The different player options of the spinner card underlying transparent disk 32 will be visible therethrough. The lower surface of disk 32 contacts the underlying spinner card to limit penetration of projecting end 33 of spinner shaft 27 to the approximate depth of the spinner card opening. The axial length of the finger grip 28 is greater than the axial length of the projecting end 33 of shaft 27.

I claim:

1. A spinner assembly for a board game comprising a transparent spinner disc having an opening therethrough, said spinner disc having an upper surface and a lower surface, a spinner shaft having a first portion and a second portion, said spinner shaft first portion originating above said spinner disc upper surface, extending through said disc opening and projecting beyond said spinner disc lower surface, said spinner shaft being fixedly secured to said spinner disc, said spinner shaft second portion providing a finger grip on said spinner shaft first portion above said spinner disc upper surface, a pointer arm pivotally mounted on said spinner shaft first portion between said spinner disc upper surface and said spinner shaft second portion, the radial extent of said transparent spinner disc being at least as great as the greatest radial extent of said pointer arm, a number of spinner scale elements each representing different player options and each having an opening therein for receipt of said spinner shaft first portion projection, one said spinner scale element underlying said spinner disc and having a said opening generally aligned with said spinner disc opening, and said spinner shaft first portion projection removably secured within said spinner scale element opening, whereby a single spinner disc, spinner shaft and pointer arm combination will function as a unit and may be employed sequentially with said spinner scale elements by removing said spinner shaft first portion projection from said spinner scale element opening and inserting said first portion projection into the opening of another said spinner scale element.

2. The spinner assembly of claim 1 wherein the different player options of said spinner scale element underlying said transparent spinner disc will be visible therethrough.

3. The spinner assembly of claim 2 wherein said spinner shaft has said second portion of larger diameter than said first portion.

4. The spinner assembly of claim 2 wherein each said spinner scale element has at least one generally circular scale divided into a number of scale sectors each representing a player option and indicating the outcome of a particular spin when indexed by said pointer arm.

5. The spinner assembly of claim 2 wherein said spinner shaft is secured to any of said spinner scale elements solely by entry of said spinner shaft first portion projection into said spinner scale element opening.

6. The spinner assembly of claim 1 wherein said disc lower surface contacts said underlying spinner scale element to limit penetration of said spinner shaft first portion projection to the approximate depth of said spinner scale element opening.

7. The spinner assembly of claim 1 wherein said finger grip axial length is greater than the axial length of said spinner shaft first portion projection.

* * * * *